US006035846A

United States Patent [19]

Saleri

[11] Patent Number: 6,035,846

[45] **Date of Patent: *Mar. 14, 2000**

[54] GAS BURNER

[75] Inventor: Giuseppe Saleri, Lumezzane S.S., Italy

[73] Assignee: SABAF S.p.A., Lumezzane, Italy

[ * ] Notice: Under 35 U.S.C. 154(b), the term of this patent shall be extended for 9 days.

[21] Appl. No.: 09/131,011

[22] Filed: Aug. 6, 1998

[30] Foreign Application Priority Data

Sep. 23, 1997 [EP] European Pat. Off. ..... 97830466

[51] Int. Cl.[7] ..... F24C 3/00

[52] U.S. Cl. ..... 126/39 H; 126/39 R; 239/558; 239/559

[58] Field of Search ..... 126/39 R, 39 H; 239/558, 559

[56] References Cited

U.S. PATENT DOCUMENTS

| | | | |
|---|---|---|---|
| 1,456,754 | 5/1923 | Anderson | 239/558 |
| 2,537,692 | 1/1951 | Mueller | 239/558 |

FOREIGN PATENT DOCUMENTS

| | | |
|---|---|---|
| 902 029 | 7/1985 | Belgium . |
| 0 552 135 | 7/1993 | European Pat. Off. . |
| 114 790 | 4/1926 | Switzerland . |
| 2 233 444 | 9/1991 | United Kingdom . |
| 2 256 268 | 2/1992 | United Kingdom . |

*Primary Examiner*—Carroll Dority
*Attorney, Agent, or Firm*—Cobrin & Gittes

[57] ABSTRACT

A burner for gas cookers (1) comprises: a central flame crown (22) concentric with two circumferential crowns (25, 26) themselves concentric; radial ducts (23) for feeding the primary gas-air mixture I to the circumferential crown and a substantially horizontal Venturi effect chamber (18) defined by facing surfaces (15, 16) and equidistant from the body (14) of the burner and from the cover of the of central flame crown respectively.

16 Claims, 5 Drawing Sheets

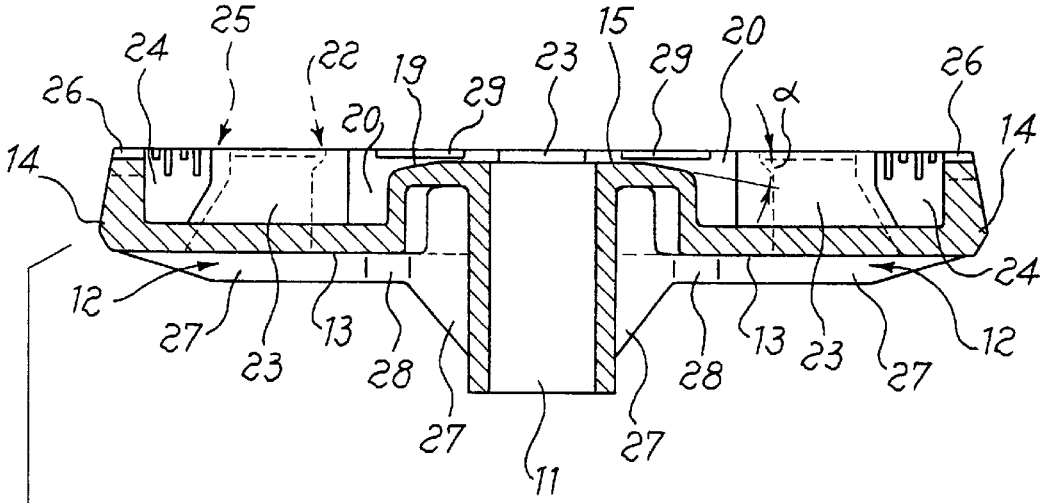
Fig.2
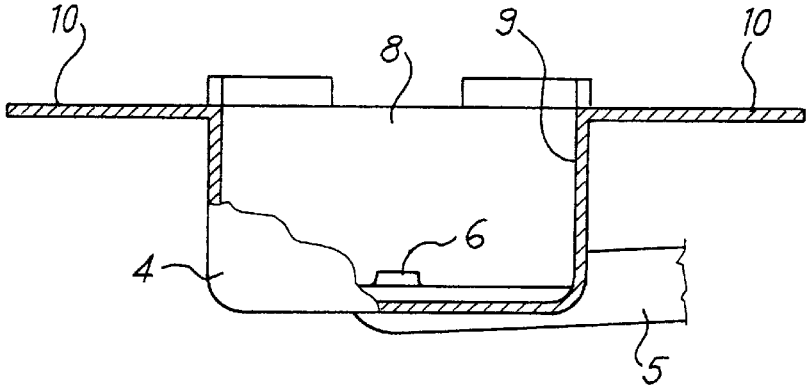

GAS BURNER

BACKGROUND OF THE INVENTION

FIELD OF THE INVENTION

The invention relates to a burner for gas cookers fitted with three-flame crowns, in particular a burner suitable for use in built-in gas-hobs.

Burners for gas cookers with two or three-flame crowns are known in the present state of the art. In particular, three-crown burners are known of which one is central and two more are external crowns; of the latter, one is turned inwards and the other towards the outside of the burner.

These burners allow uniform heating of the overlying pots irrespective of the shape of the pot base.

In the application for U.K. Patent No. GB-A-2233444, in the name of Lee, a burner is described comprising a vertical duct, which both supports the burner and feeds the gas, on which was fitted a three-crown head. The central crown is coaxial with the vertical duct and communicates with it; three connecting arms branch off from the duct to feed the mixture of primary air and gas to an external circular flame separator ring, on which are drilled the two circumferential crowns for external and internal flames.

This type of embodiment, however, is not suitable for use in gas hobs, where the low profile of the burners does not permit the use of long ducts for mixing the gas with the air. Furthermore, the internally directed circumferential flame crown has a reduced number of flames because of the interference between the facing crowns and the consequent difficulty of combustion for this type of burner.

The German Patent No. 3123751, in the name of the applicant for the present invention, describes a burner where both the primary and secondary air is drawn from above the hob and the mixture of primary air and gas is supplied to the flame-crowns through an annular chamber by of Venturi expansion effect, the horizontal Venturi.

The European Patent Application No. 0534301 in the name of Merloni, described a burner for gas cookers with a double flame-crown head. The two crowns are drilled externally and internally in a flame-separator ring which is divided internally by septal separators into sectors into which the primary air-gas mixture is supplied through a corresponding manifold. The latter embodiment, while on one hand resolving the problem of the low height profile of the burner with the adoption of the horizontal Venturi, has not resolved the problems of the prior art in that the burner is fitted with only two circumferential flame-crowns of which the more internal presents a number of extremely reduced flames and therefore insufficient distribution of the thermal energy toward the center of the burner.

EP-A-96109934.8 (Art. 54(3) EPC), in the name of the present applicant, describes a three-flame crown burner fitted with a horizontal venturi produced in a chamber formed between the base of the burner and an upper portion comprising the flame-crowns. The Venturi chamber communicates with an upper chamber defined by the base of the zone of the central crown and the central flame separator cover. This solution gives excellent performance but it has been found that it is often necessary to provide for the annealing of the burner after having bound the base of the burner to its upper portion, to eliminate the tensions generated.

OBJECTS OF THE INVENTION

The purpose of the present invention is to resolve the aforementioned problems, to produce a three-flame burner with reduced height profile, that is simple and inexpensive to produce and easy to install, that guarantees a flame that is also substantially free of turbulence and interference, particularly in the internal, central and internal circumferential crowns.

SUMMARY OF THE INVENTION

This purpose is achieved by the present invention, which relates to a burner for domestic use.

According to a preferential embodiment of the invention, the burner for gas cookers comprising three-flame crowns (of which the central is concentric with the two circumferential, which are also concentric), a means of feeding the primary air-gas mixture to the said circumferential crown and a means of feeding the said mixture to the said central crown from a chamber by Venturi effect, presents: said chamber with substantially horizontal Venturi effect is defined by the facing surfaces of the body of the burner and the cover of the said central flame crown respectively; a means of feeding the circumferential crown consisting of radial ducts communicating with the central annular chamber and with the peripheral annular chamber of the two circumferential crowns; a central cover or annular flame separator fitted with planar elements to close the said radial ducts from above.

According to another aspect the invention, the central cover and the annular flame separator are a single body comprising a flame-separator cover fitted with planar elements that connect cover and flame separator.

According to a further aspect of the invention, there is an annular conic surface adjacent to one of the facing surfaces and equidistant from the Venturi effect chamber.

According to a further aspect of the invention, the principal flames of the central crown are obtained by means of holes tilted with respect to the vertical axis at an angle of between 20 and 40 degrees.

According to a further embodiment of the invention, the pilot flame of the said central flame crown is obtained by a lamination aperture.

The burner for gas cookers produced according to the present invention, has the following advantages: the three-flame crowns produce a distribution of the thermal energy in a uniform way, so that pots are heated uniformly regardless of the base. The uniform flames of the central, internal and external circumferential crowns are free of turbulence and mutual interference. The burner can be easily installed in gas hobs, because of its low profile and maintains its characteristics of distributing heat to burners with a plurality of crowns, while the economy, and ease of assembly and cleaning remain those of a single crown burner. Furthermore, the burner can be produced in only two pieces—base and cover, avoiding having to anneal after assembly. The flame-separator cover is, in fact intended to be substantially planar: in the case where it is not, it is sufficient put it in a press to return it to its required flatness.

The invention will now be described in more detail by way of illustration but not of limitation, making reference to the enclosed tables of sketch, in which:

BRIEF DESCRIPTION OF THE DRAWINGS

FIG. 2 is diametrical section of the body of the burner and of the seat lined up as in the exploded view;

DESCRIPTION OF THE PREFERRED EMBODIMENTS

Figure 1:
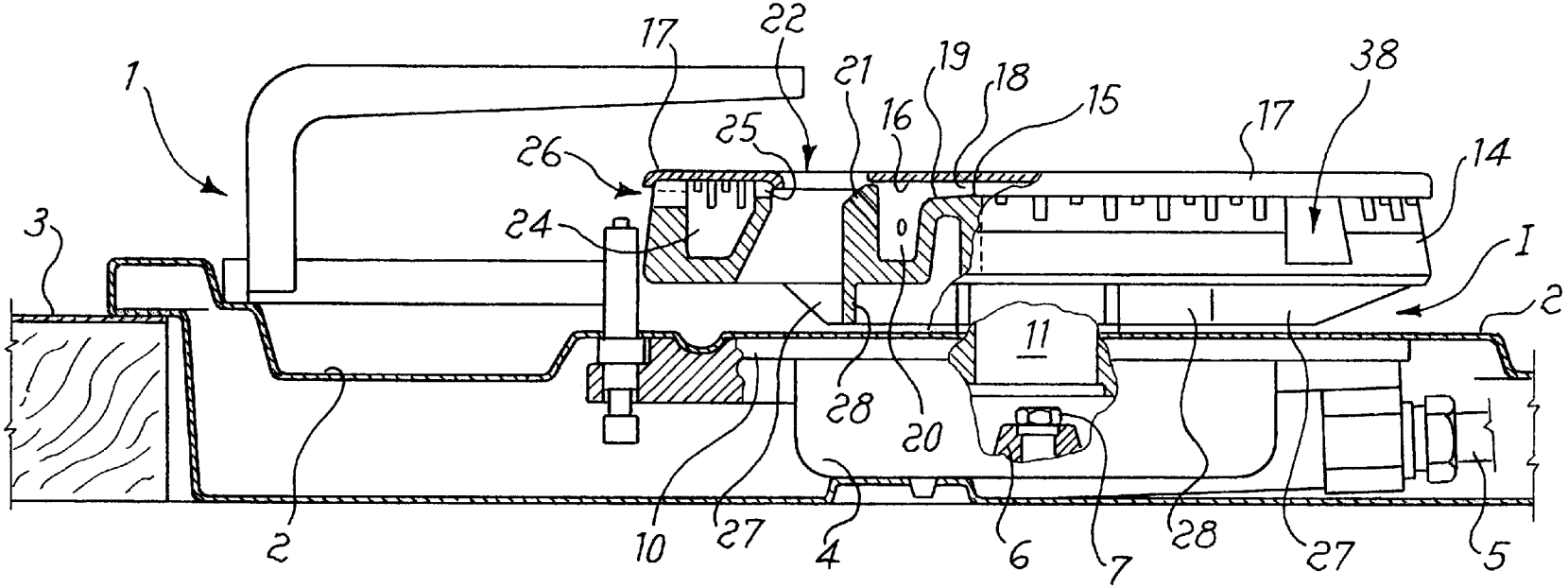
FIG. 1 is a partially sectioned side view of the burner for gas cookers according to the invention placed in a hob.

As can be seen in FIG. 1, the burner, indicated as 1 is enclosed in the cooking hob 2 with limited profile in height above the plane of the kitchen worktop 3. The base 4 of the burner presents the gas supply pipe 5 to the base 6 of the nozzle 7 for the admission of gas to the center of the chamber 8 in the said base. The side wall 9 of the chamber 8 makes contact with the lower surface of the hob 2 by means of the flange 10. In the same axis as the said nozzle, and raised above the base, is the lower end of the vertical duct 11 which diffuses the gas in the primary air I entering through the radial channels 12 located in the lower face 13 of the burner body 14.

The radial channels 12 are delimited by the radial web system 27 and by the circumferential web system 28 on the face 13 in proximity to the hole in the hob 2 between the base 4 and the vertical duct 11, which define and subdivide the course of primary air I.

The upper part of the vertical duct 11 finishes in the horizontal annular surface 15 which faces at an equal distance the lower flat surface 16 of the closing flame-separator cover 17.

Figure 5:
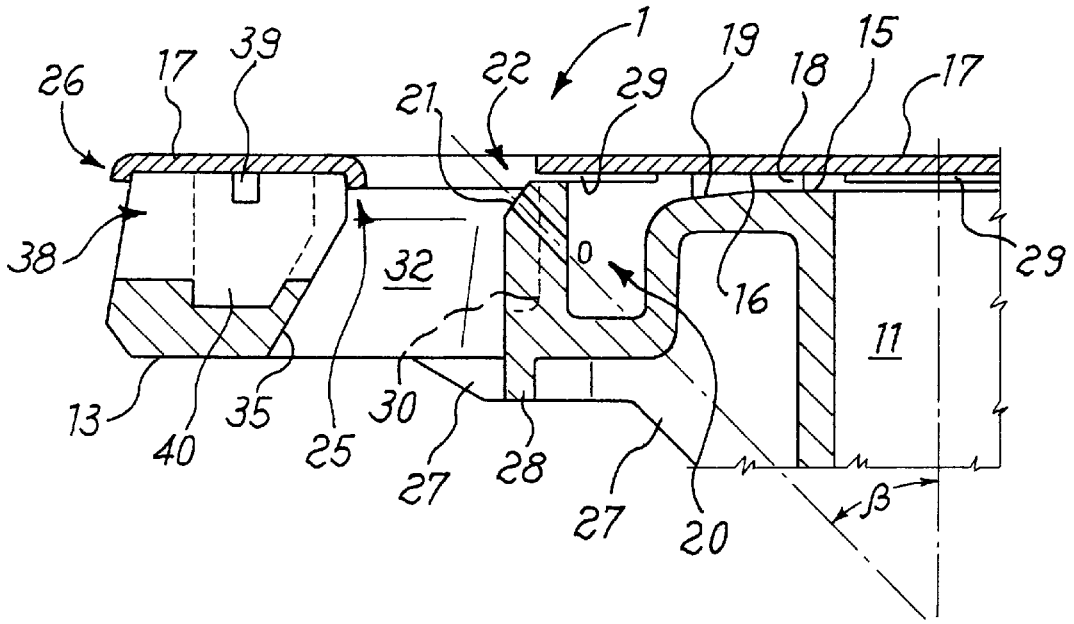
FIG. 5 is limited B—B section, suitable in FIG. 3 according to a diametrical plan, of the body of the complete burner with the flame-separator cover in one piece.
Figure 6:
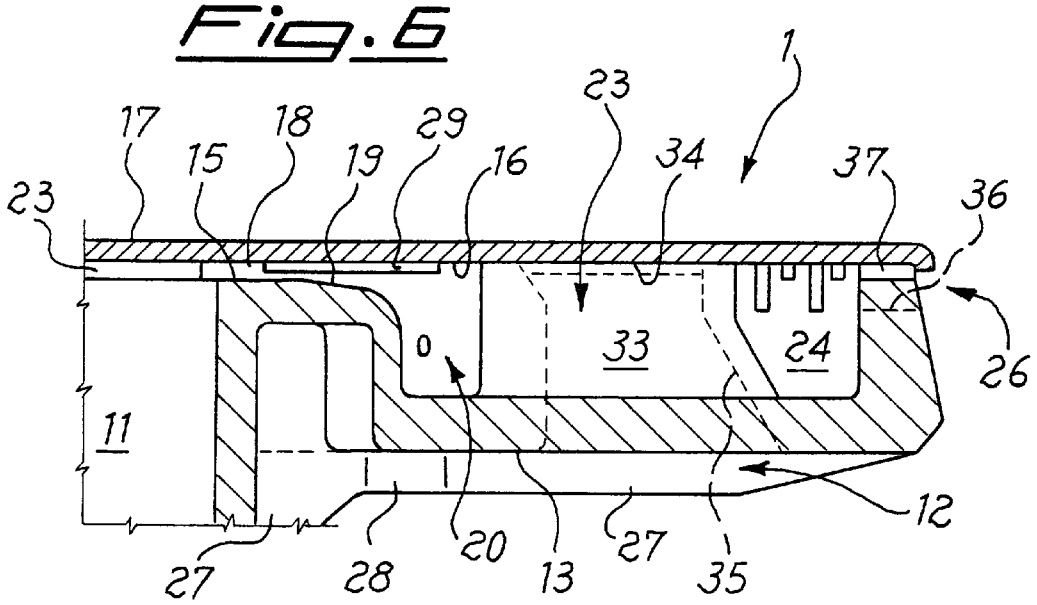
FIG. 6 is limited C—C section, suitable in FIG. 3 according to a diametrical plan, showing the body and the flame-separator cover, similar to the preceding figure.

The surfaces 15 and 16 define a horizontal chamber 18 where the radial motion of the gas creates a Venturi effect; there is a frustum (conic section) annular surface 19 adjacent to the surface 15, which constitutes a further increase in the section of the exit of the horizontal venturi. The surface 19 is therefore angled with respect to the surface 15 and opens into the central annular chamber 20 (FIG. 5) onto which open the apertures 21 that form the central flame crown 22. The radial ducts 23, visible in FIG. 2, which feed the air-gas mixture to the peripheral annular chamber 24 of the internal 25 and external 26 circumferential flame crowns, also extend from the central annular chamber 20.

FIG. 2 shows the apertures 29 (or rebates of the central crown) for the pilot flames 22 and the angle $\alpha$ of inclination of the frustum surface 19. The angle is preferably between 5 and 15 degrees.

Figure 3:
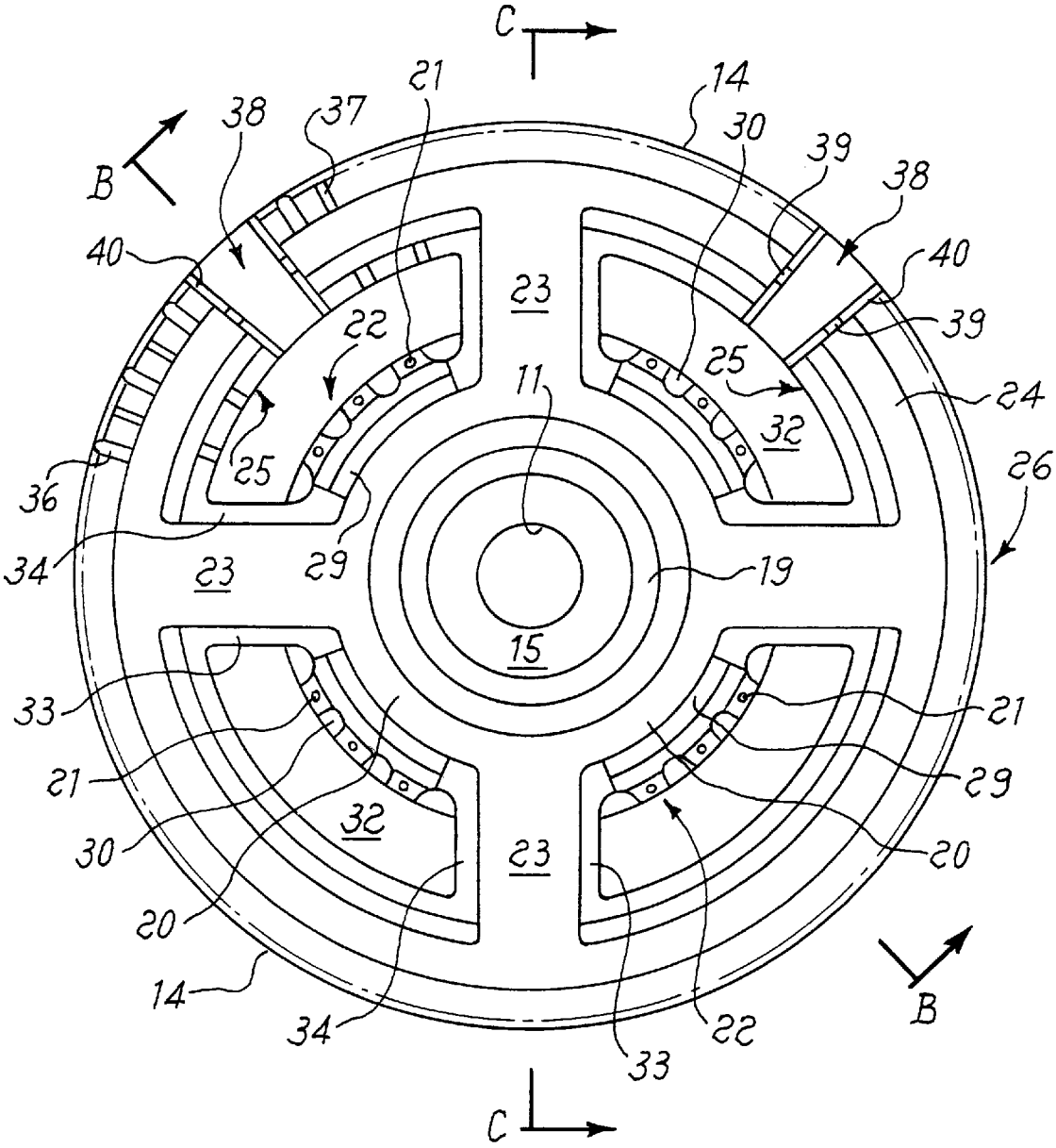
FIG. 3 is top view from the of the body of the burner, with the three crowns visible, where the incision of the principal flames and pilot of the circumferential crown are shown as a reduced arc.

FIG. 3 shows the hollows 30 cut into the central crown formed by the principal flames in the apertures 21 with inclined holes, the function of these hollows being to facilitate the presence of the flames of the internal circumferential crown 25. For this purpose, the hollows 30 face the apertures 31 of the crown 25. The holes comprising the apertures 21 of the central flame crown are inclined at an angle $\beta$ to the vertical axis of the burner. The angle is between 20 and 40 degrees.

Figure 4:
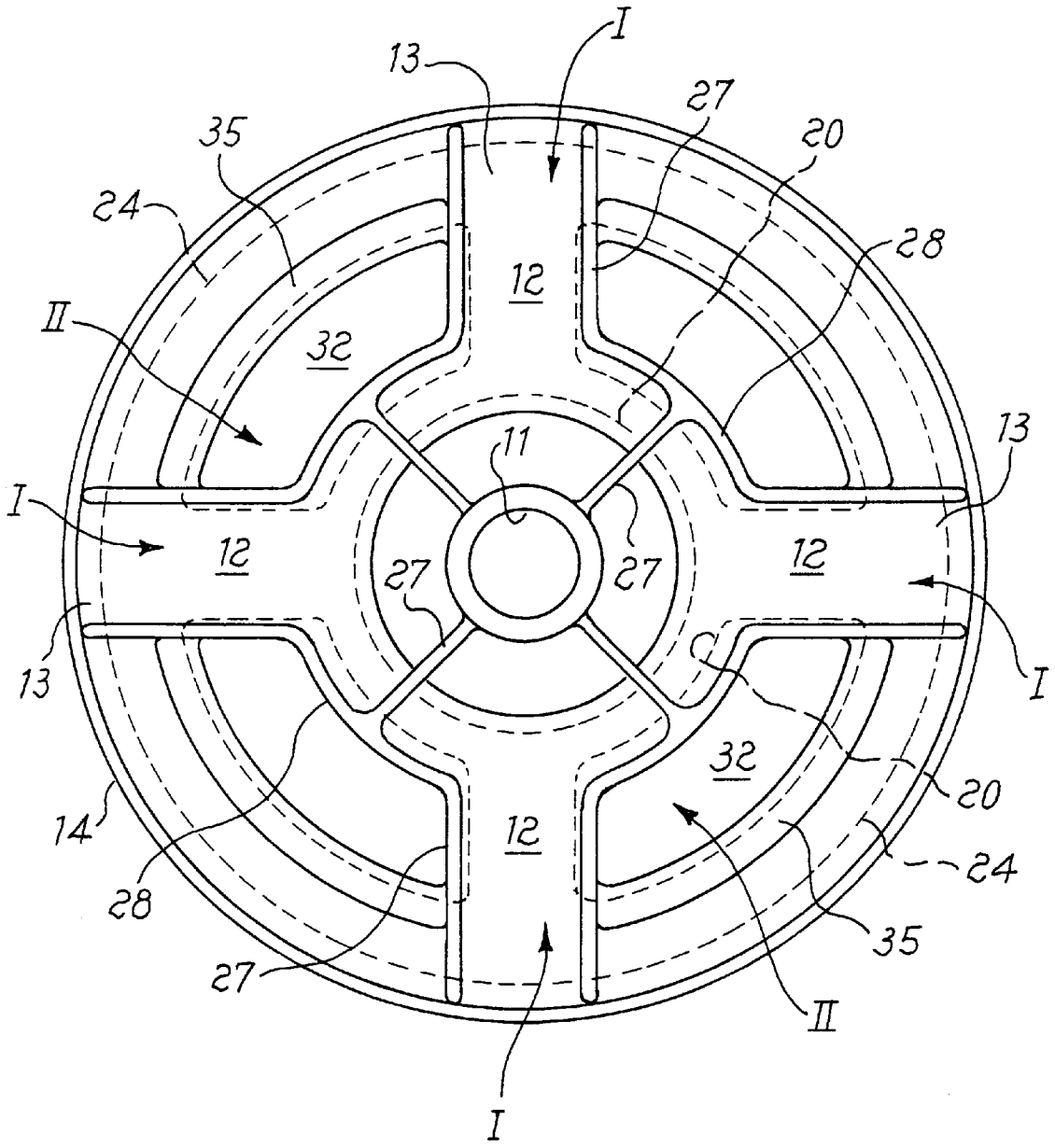
FIG. 4 is view from below of the said body of the burner with the intake channels of the primary and secondary air.

The internal circumferential flame crown 25 is equipped with only principal flames with aperture 31 facing the same arc as the flames of the central crown 22. The principal flames 21 of the central crown 22 also act as pilot lights for the internal crown 25. The secondary air for the crowns 22 and 25 originate from the arched apertures 32 cut into the lower face 13 of the body 14 and are as large as the arc between two successive ducts 23. The apertures 32 receive air radially from above the hob 2, but separately from the said radial channels 12, (see FIG. 4).

The arched apertures 32 present a conical tract 35 in the external surface underlying the crown of internal circumferential flame 25, to facilitate the influx of the secondary air II at the two internal crowns, 22 and 25.

For the purpose of facilitating mutual lighting between the flames of the external and internal crowns, there is a duct or "wave pipe" 38 (FIG. 3) located on the peripheral external annular chamber 24, corresponding to the midpoint of each of the four sectors in which the burner is divided, sectors corresponding to the apertures 32. The duct 38 comprises two walls or sides 40 complete with rebates or hollows 39 to permit the air-gas mixture present in the chamber 24 to flow into the duct 38. As can be seen from FIG. 1, the duct 38 is closed above by the cover 17 and provides for an opening on the outside of the burner and an opening onto the internal opening 32; the air-gas mixture flows therefore from the duct 38 to these flame openings corresponding to crowns 26 and 25.

The radial ducts 23 are enclosed laterally (see FIG. 3) by the sides 33 with the upper face 34 on the same level as the upper surface of the body of the burner, to ensure contact with the lower face 16 of the flame-separator cover 17. Similarly, the walls 39 of the duct 38 extend up to the same level as the upper surface of the body of the burner.

Finally, FIG. 3 shows the hollows 36 and 37 respectively of the apertures for the principal flames and pilot of the of external circumferential flame crown 26.

The burner according to the invention operates as follows: gas flows from the nozzle 6 into the chamber 8 of the base 4 where it mixes with the primary air I which originates from the radial channels 12 to flow out into the vertical duct 11. The mixture undergoes a last and complete mixing in the horizontal venturi of the chamber 18 located between the surfaces 15 and 16, respectively of the body 14 of the burner and of the flame-separator cover 17. The surfaces 15 and 16 are preferably separated by a distance of between 1.5 and 3.5 mm. The annular frustum surface 19 adjacent to the surface 15 is inclined at an angle $\alpha$ between 5 and 15 degrees with respect to the surfaces 15 of the chamber 18, to give a more marked increase in the outflow section, opening out to become the internal wall of the central chamber 20 in order to avoid turbulence in the flow. The mixture reaches the central annular chamber 20 from which depart the radial ducts 23, through which it flows to the peripheral annular chamber 24 to feed the circumferential chamber of the flame-crowns 25 and 26. A part of the mixture flows in the holes 21 of the central flame crown 22, which are inclined an angle $\beta$ between 20 and 40 degrees, preferably between 30 and 35 and more preferably around 32 degrees with respect to the vertical axis.

The primary gas-air mixture flows out for the most part into the said conduits 23 of the peripheral annular chamber 24, contained laterally by the sides 33 and above by the flame-separator cover 17, and disperses into the chamber to feed the hollows 31 of the flames of the internal circumferential crown 25 and the hollows 36 of the principal flames and hollows 37 of the pilots flames of the external circumferential crown 26.

The hollows 31 of the internal circumferential flame crown 25 are advantageously all at the same height to provide principal flames—in fact they are lit by the effect of the principal flames of the central crown 22 which face them; the interference between the said flames is reduced by the considerable influx of secondary air II flowing from the arched apertures 32 provided with considerable cross-section of passage, and from the presence of the hollows 30. A part of the mixture present in the external chamber 24 flows into the duct 38 to catch fire at the external and internal exit of the duct, with the formation of a flame under the cover, a flame that extends out from the same cover.

From tests carried out it has been shown that, although less convenient, the flame-separator cover 17 could be built in two pieces with a ring flame separator for the peripheral annular chamber 24 of the two circumferential flame-crowns 25 and 26 and a central cover for the central flame crown 22 fitted with planar elements to close the said radial ducts 23 from above. On the other hand, the two said pieces could present the planar elements inverted—i.e. of a piece with the said ring flame separator while the said central cover remains without them.

Similarly, the frustum annular surface 19 could (although less advantageously) be produced in the thickness of the flame-separator cover 17—i.e. adjacent to the lower surface 16 instead of adjacent to the annular surface 15 of the body 14 of the burner 1.

I claim:

1. Burner for gas cookers (1), suitable for burning gas, comprising three coaxial flame crowns (22, 25, 26) that include a central (22) one of the flame crowns and two circumferential (25, 26) ones of the flame crowns that form concentric rings around the central one of the flame crowns, a cover (17) of the central one of the flame crowns, a means (23) for feeding the primary gas-air mixture to the circumferential crowns and a Venturi effect chamber (18) that is defined by facing surfaces (15, 16), a first of the surfaces being an upper surface of a body (14) of the burner and a second of the surfaces being a bottom surface of the cover (17) of the central flame crown.

2. Burner according to claim 1, characterized by the means of feeding the circumferential crown consisting of radial ducts (23) communicating with a central annular chamber (20) and with a peripheral annular chamber (24) of the two circumferential crowns; the central cover including an annular flame separator being arranged to close the peripheral annular chamber (24) and being fitted with planar elements to close the said radial ducts.

3. Burner according to claim 2, characterized by the central cover and the annular flame separator being a single body constituting a flame-separator cover (17) fitted with the planar elements to unite cover and flame separator.

4. Burner according to claim 1, characterized by there being a frustum annular surface (19) adjacent to one of the surfaces (15, 16) of the Venturi effect chamber (18).

5. Burner according to claim 4, characterized by the angle of inclination of the annular surface (19) with respect to the surfaces (15, 16) of the Venturi effect chamber (18) being between 5 and 15 degrees.

6. Burner according to claim 1, characterized by an annular surface (19) being formed on the upper surface (15) of the body (14) of the burner (1).

7. Burner according to claim 1, characterized by the central crown (22) having holes (21) tilted with respect to a vertical axis at an angle of between 20 and 40 degrees, the Venturi effect chamber being arranged to extend substantially horizontal.

8. Burner according to claim 7, characterized by the angle being around 32 degrees.

9. Burner according to claim 1, characterized by the central flame crown having a lamination aperture (29).

10. Burner according to claim 1, characterized by the internal circumferential flame crown (25) presenting hollows (30) of the same height to form principal flames.

11. Burner according to claim 1, characterized by the external annular chamber (24) being fitted with a plurality of conduits (38) communicating with the said chamber (24), said conduits (38) being provided with flame openings on the external flame crown (26) and on the internal circumferential crown (25).

12. A method of burning gas with a burner of a gas cooker, comprising providing three coaxial flame crowns that include a central one and two circumferential ones, the circumferential ones forming concentric rings about the central one;

providing a path for feeding a primary gas-air mixture to the circumferential crowns and a Venturi effect chamber; and defining the Venturi effect chamber by facing surfaces that include a first that is an upper surface of a body of a burner and a second that is a bottom surface of a cover of the central one of the flame crowns.

13. Burner according to claim 1, further comprising a central vertical duct (11) and a central annular chamber (20), the Venturi effect chamber being arranged between the central vertical duct and the central annular chamber and configured to channel gas and air mixture from the central vertical duct to the central annular chamber.

14. A method as in claim 12, further comprising arranging the Venturi effect chamber between a central vertical duct (11) and a central annular chamber (20) and channeling gas and air mixture from the central vertical duct to the central annular chamber.

15. Burner according to claim 1, characterized in that the facing surfaces (15, 16) are separated from each other by an equal distance to define a horizontal chamber therebetween.

16. Method according to claim 12, characterized by separating the facing surfaces (15, 16) from each other by an equal distance to define a horizontal chamber therebetween.

* * * * *